US008833591B2

(12) United States Patent
Kotevski et al.

(10) Patent No.: US 8,833,591 B2
(45) Date of Patent: Sep. 16, 2014

(54) AMMUNITION CAN WITH SAFETY VALVE

(76) Inventors: Steve Kotevski, Bloomingdale, NJ (US); Arroyal Garner, Wantage, NJ (US); Nicole Harasts Sapp, Newton, NJ (US); Vince Gonsalves, Nazareth, PA (US); Matt Evangelisti, Denville, NJ (US); Carl Campagnuolo, Sarasota, FL (US); Nikola Kotefski, Bloomingdale, NJ (US); Steven Sicoli, Mine Hill, NJ (US)

( * ) Notice: Subject to any disclaimer, the term of this patent is extended or adjusted under 35 U.S.C. 154(b) by 0 days.

(21) Appl. No.: 13/427,244

(22) Filed: Mar. 22, 2012

(65) Prior Publication Data

US 2013/0248383 A1 Sep. 26, 2013

(51) Int. Cl.
*B65D 55/00* (2006.01)

(52) U.S. Cl.
USPC ..... 220/367.1; 220/201; 220/202; 220/89.4; 206/3

(58) Field of Classification Search
USPC ..... 220/367.1, 201, 202, 676; 206/3; 137/74, 79
See application file for complete search history.

(56) References Cited

U.S. PATENT DOCUMENTS

| | | | | | |
|---|---|---|---|---|---|
| 1,788,261 | A | * | 1/1931 | Werder | 220/610 |
| 3,731,585 | A | * | 5/1973 | Demberg et al. | 86/1.1 |
| 4,085,765 | A | * | 4/1978 | Nelson | 137/68.26 |
| 4,147,272 | A | * | 4/1979 | Stenner et al. | 220/89.4 |
| 4,195,745 | A | * | 4/1980 | Roberts et al. | 220/2.2 |
| 4,706,698 | A | * | 11/1987 | Short, III | 137/68.19 |
| 4,733,773 | A | * | 3/1988 | LaBianca et al. | 206/3 |
| 4,744,382 | A | * | 5/1988 | Visnic et al. | 137/68.23 |
| 4,744,383 | A | * | 5/1988 | Visnic et al. | 137/72 |
| 4,750,510 | A | * | 6/1988 | Short, III | 137/1 |
| 4,899,777 | A | * | 2/1990 | Stone et al. | 137/74 |
| 5,035,181 | A | * | 7/1991 | Jacks et al. | 102/481 |
| 5,042,675 | A | * | 8/1991 | Patterson | 220/89.1 |
| 5,240,027 | A | * | 8/1993 | Vertanen | 137/73 |
| 5,269,336 | A | * | 12/1993 | Subramanian | 137/73 |
| 5,307,956 | A | * | 5/1994 | Richter et al. | 222/143 |
| 5,320,127 | A | * | 6/1994 | Yanagihara et al. | 137/72 |
| 5,415,312 | A | * | 5/1995 | Mueller | 220/254.3 |
| D363,879 | S | * | 11/1995 | Krupa et al. | D9/423 |
| 5,561,915 | A | * | 10/1996 | Vandergriff | 34/201 |
| 5,577,740 | A | * | 11/1996 | Purdom | 277/637 |
| 5,762,091 | A | * | 6/1998 | Sarne et al. | 137/74 |
| 6,305,544 | B1 | * | 10/2001 | Shacklee | 206/509 |
| 6,357,582 | B1 | * | 3/2002 | Fischer | 206/3 |
| 6,367,651 | B2 | * | 4/2002 | Laib et al. | 220/676 |
| 6,401,961 | B1 | * | 6/2002 | Butler | 220/562 |
| 6,814,097 | B2 | * | 11/2004 | Girouard | 137/72 |
| 6,866,057 | B1 | * | 3/2005 | Buehrle, II | 137/74 |

(Continued)

*Primary Examiner* — Anthony Stashick
*Assistant Examiner* — James Way
(74) *Attorney, Agent, or Firm* — Scully, Scott, Murphy & Presser, P.C.

(57) ABSTRACT

A safety valve is provided for metallic ammunition cans having lids which form an environmental seals when closed, the safety valve automatically vents cook-off gases generated when ammunition or other energetic in the ammunition can reach elevated temperatures. The safety valve is deployed in a hole formed in a wall of the ammunition can. The safety valve employs a vent cover which is soldered by means of a eutectic material either directly to an outer surface of the ammunition can or to an insert extending through the hole in the wall of the ammunition can. The vent cover seals gases in the ammunition can until elevated temperatures cause eutectic solder to melt thus freeing a vent cover and releasing cook-off gases from inside of the ammunition can.

4 Claims, 4 Drawing Sheets

(56) References Cited

U.S. PATENT DOCUMENTS

| | | | | |
|---|---|---|---|---|
| 7,131,550 | B2 * | 11/2006 | Vilalta et al. | 220/231 |
| 7,641,835 | B2 * | 1/2010 | Ramsey et al. | 264/260 |
| 8,091,707 | B2 * | 1/2012 | Egan et al. | 206/523 |
| 2002/0023467 | A1 * | 2/2002 | Seagar et al. | 68/23 R |
| 2008/0110911 | A1 * | 5/2008 | Chen | 220/788 |
| 2008/0217335 | A1 * | 9/2008 | Chen | 220/231 |

* cited by examiner

AMMUNITION CAN WITH SAFETY VALVE

BACKGROUND OF THE INVENTION

1. Field of the Invention

The present invention relates in general to ammunition cans used to store ammunition, grenades, and other energetic devices, and, more particularly, to a safety valve for ammunition cans which can automatically vent cook-off gases from the ammunition can which are generated at elevated temperatures, such as encountered in fires and in desert environments.

2. Description of Related Art

A major concern in insensitive munitions is the packaging. In particular, the ammunition cans which store items such as ammunition, grenades and other energetic devices make an insensitive munition compliant assembly non-insensitive munitions compliant when placed in the ammunition can.

Specifically, military ammunition cans have an environmental seal that affects insensitive munitions when used in the ammunition cans in certain environments. In particular, when insensitive munitions cook off (generate gases at elevated temperatures to a pressure of 10 psig or more), the ammunition can does not have a means of venting these gases at elevated temperatures. Even with insensitive munitions compliant (cook off) energetic devices in an Ammunition Can, the ammunition can itself becomes an energetic device because it fragments when the energetic of its contents reach a detonation temperature. To avoid this phenomena, the ammunition can needs to be able to automatically vent in cases where it and its contents are exposed to elevated temperatures such as in a fire or in a desert environment.

It is therefore a principal object of the present invention to provide a device for use with a standard ammunition can which can vent cook-off gases.

It is another object of the present invention to automatically vent gases from ammunition cans when exposed to elevated temperatures above the operating temperatures of the stored munitions.

It is yet another object of the present invention to prevent ammunition cans from turning into fragmenting projectiles if the vent holes or openings were not there to vent cook-off gases.

BRIEF SUMMARY OF THE INVENTION

The present inventors have carried out extensive research and development in an effort to solve the problem of venting ammunition cans used to carry energetic devices. In the course of this investigation and research and development efforts, applicants unexpectedly discovered that an ammunition can be automatically vented of cook-off gases by incorporating a safety valve in the wall of the ammunition can itself.

The safety valve of the present invention comprises a support ring and vent cover assembly extending over a hole formed in a wall of the ammunition can. The vent cover is attached to a support ring with the use of a eutectic solder, and this assembly or safety valve is attached in a sealing engagement with the wall of the ammunition can either directly or indirectly. The seal formed between the safety valve support ring and ammunition can could be an adhered or epoxied joint. The seal between the support ring and vent cover is a eutectic material which turns from a solid to a liquid at a predetermined elevated temperature, thereby releasing the vent cover, and venting the ammunition can of cook-off gases.

In a first preferred embodiment there is provided a metallic ammunition can having a metallic cover which when closed forms a environmental seal with an ammunition can body, the improvement comprising:

an automatic safety valve installed in a hole in a wall of the ammunition can to vent cook-off gases generated at elevated temperatures, said safety valve comprising, a support ring and a vent cover assembly extending over a hole formed in a wall of the body of the ammunition can, the safety valve being attached in sealing engagement with a wall of the ammunition can by means of an adhered joint such as epoxy, a threaded support ring with mating nut, a crimping of the ammunition can to the support or other attachment means, and the safety valve assembly sealed with a eutectic material which turns from a solid to a liquid at a predeterment elevated temperature, thereby releasing the vent cover and venting the ammunition can of cook-off gases.

In a second preferred embodiment there is provided in connection with the first preferred embodiment an ammunition can in which the safety valve (support ring and vent cover) is formed of a material as strong as the metal forming the ammunition can.

In a third preferred embodiment there is provided in connection with the first preferred embodiment an ammunition can wherein a wall of the ammunition surrounding said hole is indented a distance equal to the thickness of said safety valve and being secured directly to an indented area of the ammunition can wall by means of a thread engagement, adhesion (epoxy or equivalent), weldment, brazing, solder or mechanical crimping to the support ring portion of the safety valve and the ammunition can wall, whereby an outer surface of the safety valve is flush with an adjacent surrounding wall of the ammunition can.

In a fourth preferred embodiment there is provided in connection with the second preferred embodiment an ammunition can wherein a portion of the indented wall of the ammunition can is threaded and these threads are in threaded engagement with threads formed on a peripheral edge of the safety valve (support ring portion).

In a fifth preferred embodiment there is provided a metallic ammunition can having a metallic cover which when closed forms an environmental seal with the ammunition can body, the improvement comprising:

an automatic safety valve installed in a hole in a wall of the ammunition can to vent cook-off gases generated at elevated temperatures, said safety valve comprising: a support ring threaded on an outer surface on one end and having a flange on the other end extending outwardly, the threaded end being sized to extend through said hole and the flange being larger than said hole and adapted to engage an outer surface of said ammunition can, said support ring having a recess or depressed portion adjacent said flange into which a vent cover is secured via eutectic solder, a locking ring having internal threads adapted to engage external threads on said support ring and lock said support ring in place, and eutectic solder holding said vent cover in place onto the supporting ring until the temperature rises to the melting point of the eutectic material.

In a sixth preferred embodiment there is provided in connection with the fifth preferred embodiment an ammunition can, wherein the depth of said recess is the same as the thickness of the safety valve.

In a seventh preferred embodiment there is provided in connection with the fifth preferred embodiment an ammunition can, wherein a locking ring is positioned in sealing engagement with an inner surface of a wall of the ammunition can, and said flange on the support ring is in contact with an outer surface of the ammunition can.

In an eighth preferred embodiment there is provided in connection with the fifth preferred embodiment an ammunition can, wherein an epoxy resin is used to seal the flange of the safety valve support ring to the outer wall of the ammunition can recess.

In a ninth preferred embodiment there is provided in a metallic ammunition can having a metallic cover which when closed forms a environmental seal with the ammunition can body, the improvement comprising:

an automatic safety valve installed in a hole in a wall of the ammunition can to vent cook-off gases at elevated temperatures, said safety valve comprising, a support ring having threads on a peripheral edge thereof, a hole formed in a wall of the ammunition can which has been embossed inwardly around edges of said hole, and threads formed in said embossed wall, said threads on the support ring adapted to engage threads formed on the embossed portion of the wall around the edges of the hole, said support ring having a through hole, and formed on an outer surface thereof is a recess into which is soldered a vent cover, said solder comprising a eutectic which melts at a predetermined temperature.

In a tenth preferred embodiment there is provided in connection with the ninth preferred embodiment an ammunition can, wherein a support ring having an inside diameter smaller in diameter than said hole and an outside diameter larger than said hole is attached to an inside wall of an ammunition can around the hole to provide a positive stop for the supporting ring.

In an eleventh preferred embodiment there is provided in connection with the ninth preferred embodiment an ammunition can, wherein said support ring of the safety valve support ring is formed with a chamfer on an outside edge and material from the ammunition can wall is deformed to force material into the chamfer voids so as to crimp the ammunition can to the support ring.

In a twelfth preferred embodiment there is provided in connection with the ninth preferred embodiment an ammunition can, wherein said support ring of the safety valve is glued—epoxied, brazed, welded or soldered to an inside wall of said ammunition can.

In a thirteenth preferred embodiment there is provided in connection with the ninth preferred embodiment an ammunition can, wherein the depth of the recess in the outer surface of the support ring is the same dimension as the thickness of the safety valve.

In a fourteenth preferred embodiment there is provided in connection with the ninth preferred embodiment an ammunition can, wherein the vent cover is positioned on the support ring so that an outer surface of the vent cover is flush with an outer wall of the ammunition can.

In a fifteenth preferred embodiment there is provided in connection with the first preferred embodiment an ammunition can, wherein said support ring and vent cover of the safety valve are formed of a material as strong as the ammunition can, and a wall of the ammunition can surrounding said hole is indented a distance equal to the thickness of said safety valve, said safety valve being secured directly to an indented area of the ammunition can wall by means of said epoxy material, whereby an outer surface of the vent cover is flush with an adjacent surrounding wall of the ammunition can.

In a sixteenth preferred embodiment there is provided in connection with a first preferred embodiment an ammunition can, wherein a wall of the ammunition can surrounding said hole is indented a distance equal to the thickness of said safety valve, said safety valve being secured directly to an indented area of the ammunition can wall by means of a thread on a portion of the indented wall of the ammunition can, and these threads are in threaded engagement with threads formed on a peripheral edge of the safety valve support ring which has the vent cover eutectically bonded to it.

In a seventeenth preferred embodiment there is provided in connection with a first preferred embodiment an ammunition can, wherein said safety valve support ring and vent cover is constructed of a material as strong as the metal forming the ammunition can, and a wall of the ammunition can surrounding said hole is indented a distance equal to the thickness of said safety valve, said safety valve outer surface is flush with an adjacent surrounding wall of the ammunition can, and a portion of the indented wall of the ammunition can is threaded and these threads are in threaded engagement with threads formed on a peripheral edge of the support ring which has the vent cover eutectically bonded to it.

In an eighteenth preferred embodiment there is provided in connection with a fifth preferred embodiment an ammunition can, wherein the depth of said recess is the same as the thickness of the safety valve, and a locking ring is positioned in sealing engagement with an inner surface of a wall of the ammunition can, and said flange on the support ring is in contact with an outer surface of the ammunition can.

In a nineteenth preferred embodiment there is provided in connection with a fifth preferred embodiment an ammunition can, wherein a locking ring is positioned in sealing engagement with an inner surface of a wall of the ammunition can, and said flange on the support ring is in contact with an outer surface of the ammunition can, and an epoxy resin is used to seal the flange of the support ring to an outer wall of the ammunition can.

In a twentieth preferred embodiment there is provided in connection with the fifth preferred embodiment an ammunition can, wherein the depth of said recess is the same as the thickness of the safety valve, and a locking ring is positioned in sealing engagement with an inner surface of a wall of the ammunition can, and said flange on the support ring is in contact with an outer surface of the ammunition can, and an epoxy resin is used to seal the flange of the support ring to an outer wall of the ammunition can.

DETAILED DESCRIPTION OF THE INVENTION

Figure 1:
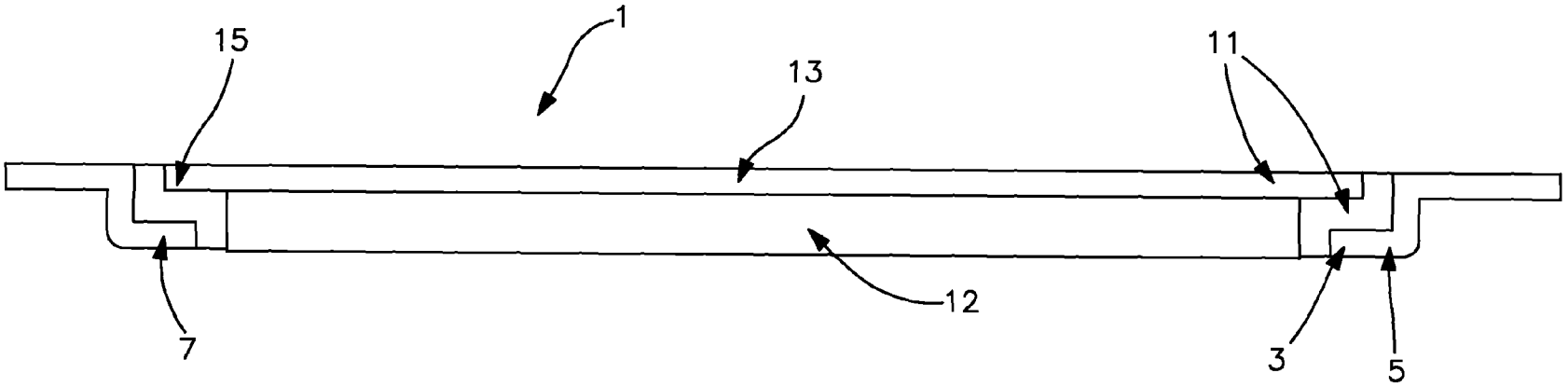
FIG. 1 is a cross-sectional side view of a safety valve of the present invention formed in a wall of an ammunition can, illustrating in particular the configuration of a support ring and its connection to a wall of the ammunition can.

In a preferred embodiment of the present invention shown in FIG. 1 is a safety valve illustrated generally at 1 installed in a hole 3 in wall 5 of an ammunition can. In this embodiment, an area 7 (embossed area for support ring 12 contact) around hole 3 can be drawn and embossed into which safety valve 11 is inserted. Safety valve 11 is preferably formed of a metal as strong as the material from which the ammunition can 5 is formed and consists of support ring 12 and vent cover 13 sealed with a eutectic15. In this embodiment, safety valve 11 is directly adhered/joined to the ammunition can 5 at area 7 by means of an epoxy or other means of attachment (adhesion, solder, braze, weld and etc. . . . ) for a secure attachment.

In the embodiment shown in FIG. 1, a eutectic joint can be soldered directly between a surface of the vent cover 13 and the indented portion of ring support 12 with a eutectic material 15 which turns from a solid to a liquid at a predetermined elevated temperature, thereby releasing the vent cover and venting the ammunition can of cook-off gases.

In another preferred embodiment a portion of the indented area can be threaded (not shown) and these threads are in locking engagement with other threads (not shown) formed on support ring 12. In this construction, as the temperature and pressure rises from cook-off gases, the eutectic 15 melts and the pressure causes vent cover 11 to be released, thus causing venting of cook-off gases.

In the design innovations of the present invention for vented ammunition cans, it is important to maintain the original wall strength so that rough handling does not impact the environmental seal made by the safety valve 11 and the ammunition can 5. This means that similar strength materials need to be used for the safety valve 11, such that the seal and mechanical properties of the ammunition can are replicated in a transparent design.

Preferably, material selections are made to meet the current ammunition can material properties. The vents employed with the safety valves of the present invention can be circular, rectangular or varied in shape.

Figure 2:
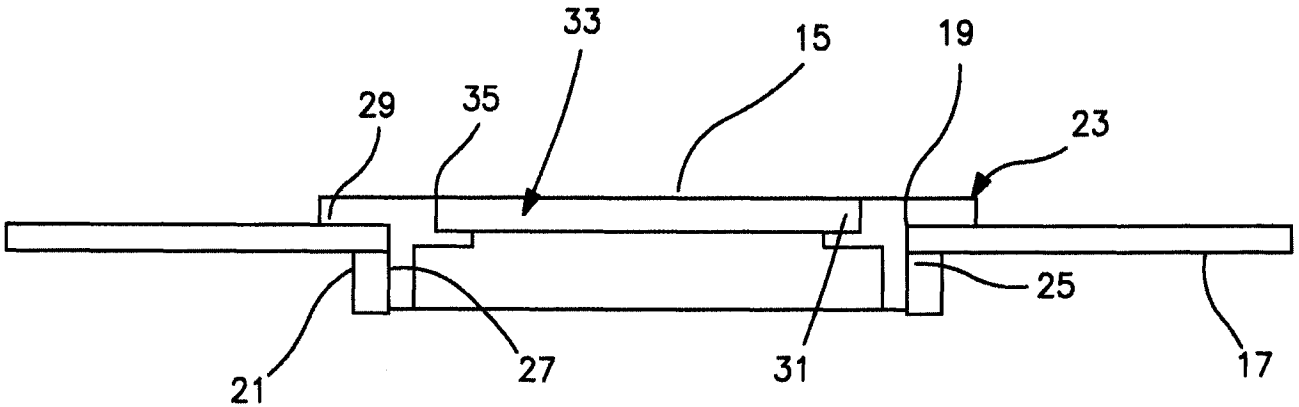
FIG. 2 is a cross-sectional side view of a safety valve of the present invention formed in a wall of an ammunition can, illustrating another preferred embodiment of connecting an automatic safety valve to a wall panel of an ammunition can in which a locking nut is employed to secure the safety valve to the wall panel of the ammunition can.

In the preferred embodiment of the present invention shown in FIG. 2 is a safety valve illustrated generally at 15 in ammunition can wall 17. Safety valve 15 is held in hole 19 by means of a threaded assembly comprising support ring 23 and locking nut 21 which is shown in FIG. 2 in threaded engagement with support ring 23 and ammunition can wall 17. Threads 25 are shown on an inside wall of locking nut 21, and matching threads 27 are also shown on an outer wall of support ring 23.

Flange 29 extends outwardly from support ring 23 beyond an edge 19 of the hole. Flange 29 is shown in sealing engagement with an outside wall 17 of an ammunition can when locking nut 21 is snug against an inside wall 17 of the ammunition can.

To provide an environmental seal for safety valve 15, either an O ring or epoxy resin adhesive can be employed between flange 29 and an outer surface of the ammunition can. Support ring 23 is also provided on its exterior surface with a recess 31 into which vent cover 33 is secured by means of eutectic solder 35.

Figure 3:
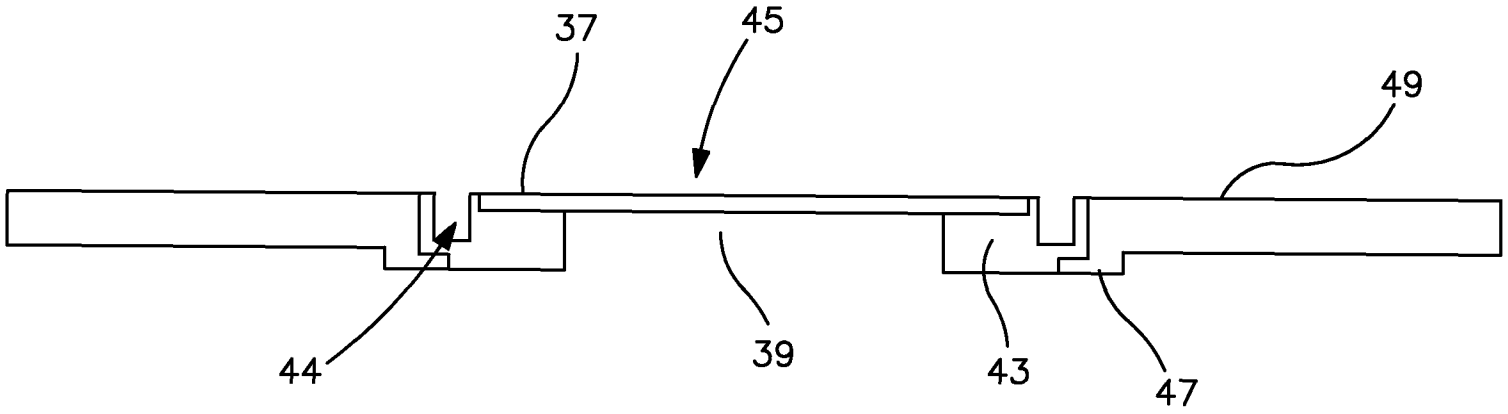
FIG. 3 is a cross-sectional side view of a safety valve of the present invention formed in a wall of an ammunition can, illustrating another preferred embodiment of connecting the safety valve to a threaded and embossed section of the wall of the ammunition can.

In another preferred embodiment of the present invention there is shown in FIG. 3 safety valve shown generally at 37 in which the ammunition can has been drawn and embossed around the edge of hole 39 to form a recess 47 into which support ring 43 is held. The recess 47 can be provided with a slip fit for support ring 43 and epoxy environmental seal or with threads (not shown) to hold support ring 43 locked in position in hole 39. Spanner wrench holes 44 can be added to facilitate tightening of the support ring 43 onto threaded hole 39.

Recess 50 can be provided with an inwardly extending portion or stop which maintains an outer surface of support ring 43 and vent cover 45 in a position flush with ammunition can outer wall 49. In this embodiment, vent cover 45 is soldered with a eutectic material to hold the vent cover 45 securely to support ring 43 at recess 50 until the temperature reaches the melting point of the eutectic.

In these embodiments, the eutectic joint forms a seal and bond between the support ring 43 and vent cover 45. This eutectic joint is a metallic seal between the support ring 43 and vent cover 45 and with the metallic material of the support ring and vent cover, and impact forces to which an ammunition can may be exposed to will not compromise the safety valve. The eutectic supports the vent cover 45 while the support ring 43 in recess 50 area absorbs any impact energy that external forces may apply onto vent cover 45. Whether the cook-off of ammunition is fast or slow, the eutectic material will remain solid under normal operating temperatures as needed by the payload (normally minus −60 to +160 Degrees Fahrenheit). Above a specified predetermined temperature (depending on the composition of the eutectic), the eutectic material phase changes from a solid to a liquid.

In this phase change, the ammunition can because of the temperature exposure will have an internal "hoop pressure" which aids in the expulsion of the vent cover 45 from the support ring 43.

Additionally, based on the orientation of the ammunition can, gravity also aids in removal of the vent cover 45 from the support ring 43.

Figure 4:
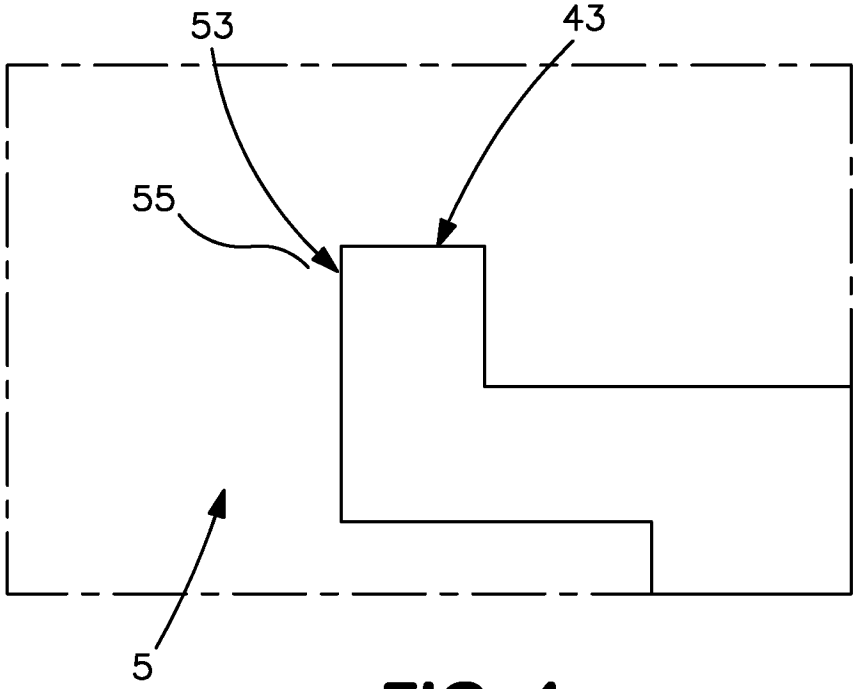
FIG. 4 is an exploded cross-sectional side view of a safety valve of the present invention, illustrating a preferred embodiment, in which a chamfer is formed on an edge of the support ring and material forming the ammunition can is then deformed and forced into the chamfer void to strengthen the joint between the ammunition can and the safety valve of the present invention.

In another preferred embodiment, in FIG. 4 displays a slip fit of a support ring 43 into the embossed nest of the ammunition can wall 5. As in FIG. 3, an epoxy environmental seal can be made but a chamfer 53 of about 45 degrees is formed on an edge of support ring 43, so that ammunition can wall 5 can be staked/crimped or swaged onto support ring 43 to provide the joint added mechanical strength. An edge portion 55 of ammunition can wall 5 can then be deformed so as to force material forming ammunition can wall 5 to be deformed and flow into chamfered void 55 of support ring 43. This crimping of the ammunition can material provides added strength between wall 5 and the safety valve of the present invention.

What is claim is:

1. In a metallic ammunition can having a metallic cover which when closed forms a environmental seal with an ammunition can body, the ammunition can body having an inner and outer surface, the improvement consisting of: an automatic safety valve having an inner and outer surface, installed in a hole in a wall of the ammunition can, such that the outer surface of the automatic safety valve is flush with the outer surface of the ammunition can body, wherein the automatic safety valve vents cook-off gases generated at elevated temperatures, said safety valve consisting of: a support ring directly attached to the wall of the body of the ammunition can, and a vent cover assembly extending over a hole formed in a wall of the body of the ammunition can, wherein the support ring extends from the outer surface of the wall of the ammunition can, through the hole formed in the wall of the ammunition can, and into the inner surface, the safety valve being attached in sealing engagement with a wall of the ammunition can by means of an adhered joint, wherein the vent cover assembly lacks a central bore and wherein the vent cover assembly is sealed to the support ring using a eutectic material which turns from a solid to a liquid at a predetermined elevated temperature, thereby causing the vent cover assembly to fall away from the support ring and venting the ammunition can of cook-off gases before pressure inside the ammunition can increases.

2. The ammunition can of claim 1, wherein said safety valve support ring and vent cover assembly maintains the environmental seal during rough handling.

3. The ammunition can of claim 1, wherein the adhered joint is selected from the group consisting of: an epoxy joint, weldment, brazing, solder, and embossing.

4. The ammunition can of claim 1, wherein the automatic safety valve does not alter the wall strength of the ammunition can.

* * * * *